US005155946A

United States Patent [19]

Domann

[11] Patent Number: 5,155,946

[45] Date of Patent: Oct. 20, 1992

[54] METHOD AND APPARATUS FOR PRODUCING A WATER/ABRASIVE MIXTURE FOR CUTTING AND CLEANING OBJECTS AND FOR THE PRECISE REMOVAL OF MATERIAL

[75] Inventor: Hannes Domann, Geesthact, Fed. Rep. of Germany

[73] Assignee: GKSS Forschungszentrum Geesthacht GmbH, Geesthacht, Fed. Rep. of Germany

[21] Appl. No.: 729,320

[22] Filed: Jul. 12, 1991

Related U.S. Application Data

[63] Continuation-in-part of Ser. No. 458,784, Dec. 29, 1989, abandoned.

[30] Foreign Application Priority Data

Dec. 30, 1988 [DE] Fed. Rep. of Germany ..... 3844344

[51] Int. Cl.[5] ..... B24C 3/00

[52] U.S. Cl. ..... 51/410; 51/439; 239/428; 239/434

[58] Field of Search ..... 51/410, 427, 439; 239/428, 431, 434, 434.5, 438, 456

[56] References Cited

U.S. PATENT DOCUMENTS

| | | | |
|---|---|---|---|
| 3,749,377 | 7/1973 | Sater et al. | 239/428 X |
| 4,067,150 | 1/1978 | Merrigan | 51/439 X |
| 4,340,039 | 7/1982 | Hibbard et al. | 239/434 X |
| 4,648,215 | 3/1987 | Hashish et al. | 51/439 |
| 4,817,874 | 4/1989 | Jarzebowicz | 51/439 X |
| 4,836,455 | 6/1989 | Munoz | 51/439 X |
| 4,872,615 | 10/1989 | Myers | 51/439 X |
| 4,945,688 | 8/1990 | Yie | 51/439 |

FOREIGN PATENT DOCUMENTS

| | | | |
|---|---|---|---|
| 115572 | 5/1989 | Japan | 51/439 |

*Primary Examiner*—James G. Smith
*Attorney, Agent, or Firm*—Robert W. Becker & Associates

[57] ABSTRACT

A method and apparatus for producing a water/abrasive mixture for cutting and cleaning objects and for the precise removal of material. In a mixing chamber, an abrasive is introduced into a jet of water that is under high pressure and passes through the mixing chamber from an inlet to an outlet thereof. The abrasive is conveyed directly and precisely into the water jet in the mixing chamber along the shortest path.

18 Claims, 6 Drawing Sheets

METHOD AND APPARATUS FOR PRODUCING A WATER/ABRASIVE MIXTURE FOR CUTTING AND CLEANING OBJECTS AND FOR THE PRECISE REMOVAL OF MATERIAL

BACKGROUND OF THE INVENTION

This application is a continuation-in-part application of application Ser. No. 458,784, filed Dec. 29, 1989.

The present invention relates to a method and apparatus for producing a water/abrasive mixture for cutting and cleaning surfaces or objects and for the precise removal of material, by introducing an abrasive, in a mixing chamber, into a jet of water that is under high pressure and that passes through the mixing chamber from an inlet to an outlet thereof.

Methods of this general type are known where particles of hard material (abrasive) are added to high pressure water jets to produce a mixture for cleaning and cutting surfaces or objects. The advantage of using such water/abrasive mixtures rather than utilizing a thermal process for cutting objects is that the cutting location remains practically cold, which is of particular advantage when using the process for cutting or cleaning objects that are sensitive to heat. Water/abrasive mixtures are also very suitable for cutting and cleaning or for the removal of material in underwater applications.

With one known method of the aforementioned general type (U.S. Pat. No. 4,648,215, Hashish et al, issued Mar. 10, 1987), abrasive is added to a water jet that passes through a mixing chamber of an apparatus for cutting and cleaning via a water/abrasive mixture. In particular, the abrasive is supplied at an acute angle relative to the water jet. The diameter of the mixing chamber is less than the free length of the jet in the chamber.

This known supply technique results in the considerable drawback that after a short period of use, pits or cavities form in the wall of the mixing chamber on that side opposite the abrasive nozzle; these cavities rapidly become very large. As a result of the formation of these disadvantageous cavities, the known apparatus, already after a relatively short period of use, can no longer operate as designed.

Pursuant to the known apparatus of the aforementioned U.S. Pat. No. 4,648,215, an attempt was made to check this phenomenon by providing at least that lower portion of the mixing chamber where the outlet is provided with a hard metal lining that on the one hand has the drawback that it considerably increases the cost of producing such an apparatus, and on the other hand also leads to erosion effects in the abrasive introduction nozzle that is directed into the mixing chamber due to the fact that the lining scatters abrasive back. This caused considerable wear of the nozzle, so that tests under actual conditions of use showed that this known apparatus, and the method carried out therewith, fell short of expectations.

It is therefore an object of the present invention to provide a method and apparatus for improving the effectiveness of the mixing process in the mixing chamber, of increasing the output (hydraulic capacity), and increasing the service life of the mixing chamber and of the discharge nozzle.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
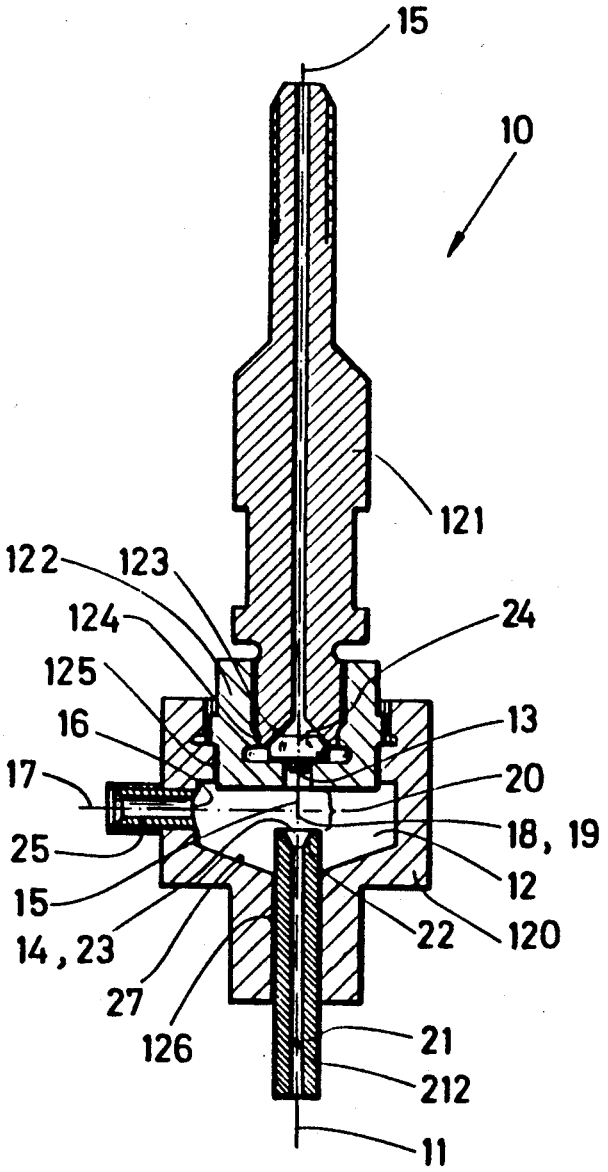
FIG. 1 is a cross-sectional view of one exemplary embodiment of the inventive apparatus showing a mixing chamber as well as a discharge nozzle that is disposed in the apparatus and a jet of water that passes through the mixing chamber.
Figure 2:
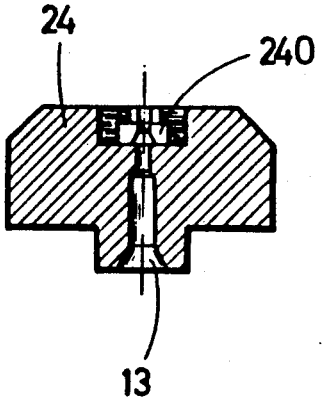
FIG. 2 is an enlarged cross-sectional view showing a nozzle insert that includes the discharge nozzle of the water jet for entry into the mixing chamber.

The method of the present invention is characterized primarily in that the abrasive is conveyed directly and precisely into the water jet that passes through the mixing chamber.

The advantage of the inventive method is that, in contrast to the known state of the art where only a small portion of the abrasive enters the water jet directly and the greatest portion of the abrasive passes into the conical lower portion of the mixing chamber where first an orientation of the path of the individual particles of the abrasive is effected in the direction of the axis of the water jet before the particles of the abrasive are jetted by the spray fraction of the water jet into the directly adjoining nozzle funnel of the discharge nozzle, with the present invention, the particles of the abrasive, long before they reach the outlet, i.e. pass into the inlet opening of the discharge nozzle, are accelerated, in other words, the free length of the stream of the water jet in the mixing chamber can be fully utilized to transfer energy since the particles of the abrasive are blown along the shortest path into the water jet that passes through the mixing chamber.

A further advantage of the inventive method is the ability to realize small free stream or jet lengths in the mixing chamber. The slight divergence of the stream that results therefrom during entry of the water/abrasive mixture into the inlet opening of the abrasive nozzle causes less wear in a discharge nozzle and smaller power losses during focusing of the abrasive jet in the discharge nozzle.

Pursuant to one advantageous specific embodiment of the inventive method, the abrasive is conveyed into the mixing chamber in such a way that the abrasive also collects about the outlet while forming an abrasive channel, with the formation of the channel being automatically effected within the first seconds in the mixture that is deposited about the outlet immediately after start up, which mixture comprises the spray fraction of the water jet and the supplied dry abrasive. The tapering of the abrasive channel about the water jet in the mixing chamber effects an increase of the air speed in this region and hence additionally accelerates the hard material particles. In addition, the wall of the mixing chamber is protected from erosion by the abrasive itself, which with the aforementioned known apparatus very rapidly makes the apparatus unusable.

The abrasive can also preferably be conveyed into the mixing chamber in such a way that it is deposited on all of the walls of the mixing chamber, thereby reliably protecting these walls from damage due to erosion.

Pursuant to another advantageous specific embodiment of the inventive method, the abrasive is conveyed into the water jet at essentially right angles to the axis thereof, thus resulting in an optimum supply of the abrasive to the water jet; in other words the shortest possible path is provided from the mouth of the abrasive inlet to the water jet.

It has been shown that in principle the abrasive can be conveyed into the mixing chamber at any desired pressure. In applications in a normal atmosphere however, the abrasive is preferably added to the mixing chamber in a pressure range of 1 bar relative to the inner pressure of the mixing chamber. However, abrasive pressures of 1 to 120 bar are also possible.

The inventive apparatus for carrying out this method is characterized primarily in that the axis of the abrasive inlet in the mixing chamber extends essentially perpendicular to the axis of the water jet in the mixing chamber.

The advantage of this novel arrangement is essentially that the particles of abrasive that are blown in via the abrasive inlet are conveyed into the water jet along the shortest path, so that the inventive object of obtaining an optimum feed geometry for the abrasive is achieved.

In principle, the mixing chamber can have any desired configuration. However, it has been shown that it is advantageous for the mixing chamber to have an essentially cylindrical cross-sectional configuration with the axis of the water jet being the axis of the cylinder, and with the diameter of the mixing chamber being greater than the free length of the path of the water jet through the mixing chamber. Mixing chambers of this type are relatively easy to produce and, due to their symmetrical construction, offer in all directions a uniform radial spacing about the axis of the water jet, so that during start-up, moistened abrasive that collects about the outlet as intended can pile-up uniformly.

About the outlet, the mixing chamber preferably has a funnel-shaped configuration, i.e. has a conical cross-sectional configuration, so that especially when the discharge nozzle, for the discharge of the water/abrasive mixture out of the apparatus, preferably projects at least partially into the mixing chamber, a dead space can form that is a starting point for the deposition of the moistened abrasive at the base of the mixing chamber. The discharge nozzle is basically advantageously disposed in the center of the cylindrical mixing chamber. However, other configurations are also conceivable where the discharge nozzle is not disposed concentric to the axis of the mixing chamber, for example where adjustable centering aids are provided.

Pursuant to the present invention, it is not absolutely necessary that the discharge nozzle be made of hard material. Furthermore, in addition to a one-piece construction, the discharge nozzle can also advantageously be segmented. However, the discharge nozzle is advantageously made of a hard metal such as tungsten carbide or the like. This construction takes into account the fact that with the inventive apparatus merely the discharge nozzle is subjected to great stress from the water/abrasive mixture that passes therethrough, and the preceding mixing chamber is not stressed in this manner since the moist abrasive mixture is deposited about the outlet of the mixing chamber. To this extent, the inventive mixing chamber can be formed of materials that are more economical to produce than is the hard metal discharge nozzle, with such material being easy and hence economical to work.

Pursuant to another advantageous specific embodiment of the inventive apparatus, on that side that faces the mixing chamber the inlet nozzle has a funnel-shaped configuration, increasing in size in the direction toward the mixing chamber. This configuration of the discharge nozzle is advantageous because the water jet that passes through the mixing chamber widens between the time that it enters the mixing chamber and the time it leaves the same. Due to the funnel-shaped configuration of the outlet or discharge nozzle, the water jet that already contains the abrasive is again brought together.

Pursuant to a different advantageous specific embodiment of the present invention, having a similar effect as that previously described, the discharge nozzle can be provided on that side that faces the mixing chamber with an inlet bore that enlarges the nozzle opening. However it should be noted that in neither case is the funnel-shaped configuration of the opening of the discharge nozzle that is directed toward the mixing chamber absolutely necessary in either the funnel-shaped form or in the form of the cylindrical bore.

Where small water diameter nozzles are used, i.e. where the hydraulic power is low, such as is advantageously used in order to achieve thin precision cuts, the expansion of the jet due to the short free jet length that is possible with the present invention, is so small that no additional widening of the abrasive nozzle bore in the inlet region is required.

In order to be able to overall optimize the effectiveness of the inventive apparatus for each predetermined application, it is advantageous to select the free jet length of the water jet within the mixing chamber. To do so, it is advantageous for the distance (free path length) between the inlet and the outlet of the water jet in the mixing chamber to be adjustable, with this distance or spacing advantageously being adjusted by shifting of, for example, the discharge nozzle in the direction of the axis of the water jet. For example, the free path lengths of the water jet within the mixing chamber could be adjusted between 2 and 80 mm. Means for adjusting the free path length spacing between the first inlet and the outlet for the water jet in the mixing chamber are provided. The adjusting means may comprise means for shifting the discharge nozzle and/or the holder for a nozzle insert at which the first inlet of the mixing chamber is disposed. The adjusting means may further comprise means for securing the discharge nozzle and/or the holder within a mixing chamber body. The securing means, for example, may be in the form of a set screw engaging the discharge nozzle and/or the holder for the nozzle insert. Alternatively, a shoulder may be provided at either the discharge nozzle or the holder whereby the respective shoulder rests at a corresponding further shoulder or abutment of the mixing chamber body.

In order to be able to adapt to the selected free path length of the water jet between the inlet and the outlet of the mixing chamber, the cross-sectional configuration of the abrasive inlet could also be variable, with this advantageously being effected by disposing in the abrasive inlet a sleeve having a suitably selected throughbore cross section.

For certain applications, instead of having merely one abrasive inlet, it is advantageous to provide a plurality of abrasive inlets that are directed toward the mixing chamber and that all have their axes oriented essentially perpendicular to the axis of the water jet. Depending upon the application, the abrasive inlets can be distributed in a suitable manner in the mixing chamber about the axis of the water jet, and can even be disposed at varying heights between the inlet and the outlet of the mixing chamber.

Finally, it is advantageous to provide precision cylindrical or conical fitting elements to achieve a centering of the abrasive nozzle bore relative to the axis of the water jet.

Further specific features of the present invention will be described in detail subsequently.

DESCRIPTION OF PREFERRED EMBODIMENTS

Referring now to the drawings in detail, the apparatus 10 essentially comprises a mixing chamber body 120 as well as a so-called connector 121, the free end of which is connected in a known manner with a pressure line. The connector 121 has a throughbore that extends essentially centrally therethrough and through which the stream of water 15 that is supplied via the non-illustrated pressure line passes. Provided at the bottom end of the connector 121 that faces the mixing chamber 12 is a nozzle insert 24 that surrounds, for example, the high pressure water nozzle means 240 that is made of a hard material such as sapphire or the like. The nozzle insert 24 has a throughbore that essentially extends centrally therethrough, with that end of the throughbore that faces the mixing chamber 12 forming an inlet 13 for the water or water jet 15 into the mixing chamber 12. If it becomes worn, damaged, or it is desired to change the diameter of the water jet 15, the nozzle insert 24 can be replaced very rapidly, because it is retained between the connector 121 and a holder 122 in a conical centering opening via a threaded connection between the components 121 and 122.

Figure 5A:
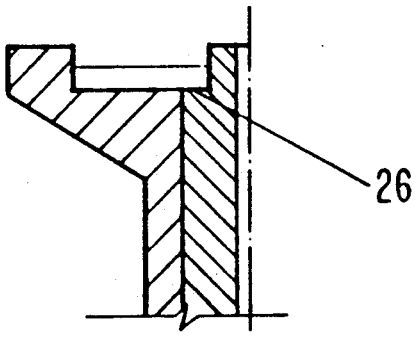
FIG. 5*a* shows an enlarged view of the discharge nozzle of FIG. 5.
Figure 5:
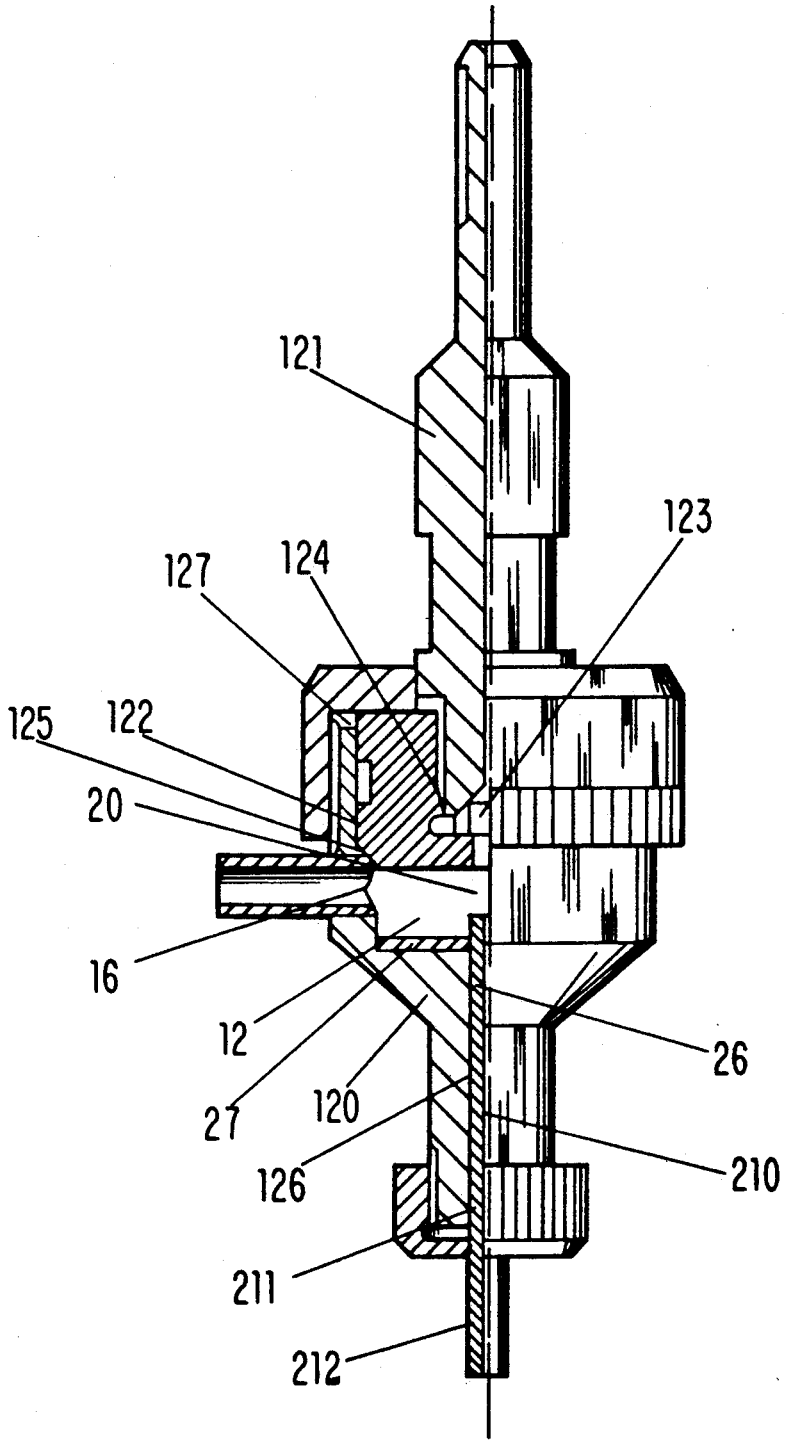
FIG. 5 is a partially cross-sectioned view of another exemplary embodiment of the inventive apparatus.

The mixing chamber body 120 is essentially axially symmetrical, as can be seen from FIGS. 1 and 5. Provided within the mixing chamber body 120 is an essentially cylindrical mixing chamber 12 in which, as will be described in detail subsequently, the abrasive 160 is blown into the jet of water 15 that passes through the mixing chamber 12 from the inlet 13 to the outlet 14 thereof.

The bottom end of the mixing chamber 12, which faces the outlet 14, is tapered in a funnel-like manner in the embodiment of FIG. 1. However, as shown in the embodiment of FIG. 5, the bottom end of the mixing chamber 12 could also have a planar configuration.

In the illustrated embodiment, the axis 18 of the jet of water 15 coincides with the axis of the cylindrical mixing chamber 12. At the bottom end, i.e. in the funnel-shaped portion of the mixing chamber 12, a discharge nozzle 21 is disposed in the extension of the axis 18 of the water jet 15. The discharge nozzle 21 is made of a hard material and has a central throughbore to allow the water/abrasive mixture 11 to pass through.

Figure 1A:
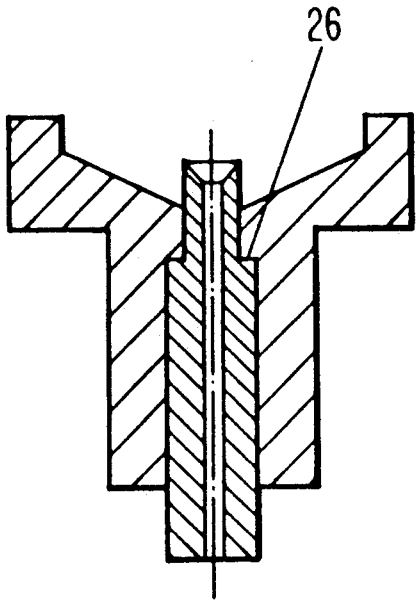
FIG. 1*a* is an enlarged view of the discharge nozzle of FIG. 1.

In addition, the discharge nozzle 21 can be provided with a shoulder 26 that can come to rest against a corresponding shoulder or rib in the mixing chamber body 120 (FIG. 1*a*, FIG. 5*a*). By varying the location of the shoulder 26 for different discharge nozzles, the entry depth to which the respective discharge nozzle extends into the mixing chamber 12 may be varied.

The adjustment of the free distance or spacing 20 to a desired value may also be achieved by shifting the discharge nozzle 21 within the mixing chamber body 120 and securing the selected position with a respective securing means that engages the discharge nozzle 21. For example, such a securing means may be in the form of a setscrew or lock bolt.

Furthermore, relative to the entry depth of the discharge nozzle 21 into the mixing chamber 12, and in relation to the inner diameter for the through passage of the water/abrasive mixture 11, variously configured discharge nozzles 21 can be used that can be adapted to the correspondingly desired cutting or cleaning parameters of the desired insert. The degree to which the discharge nozzle 21 extends into the mixing chamber 12 determines the free distance or spacing 20 of the water jet 15 between the inlet 13 and the outlet 14. The outlet 14, in this embodiment, is formed by the funnel-shaped configuration 22 of the nozzle opening 23.

As illustrated in FIG. 5, the discharge nozzle could also be segmented. The advantage of this construction is that it is easier to produce the precision bore in the hard-material nozzle, especially where small diameters are involved, due to the shorter construction of the nozzle parts. Furthermore, it is frequently only the lower portion 211 of the nozzle that needs to be replaced when this becomes necessary due to wear of the focusing bore. After not too great operating times, the upper used nozzle portion 210, while maintaining the jet parameters, frequently has a suitable inlet geometry, like a new nozzle, since it is ground by the action of the preceding abrasive stream.

The axis 17 of the abrasive inlet 16 extends essentially perpendicular to the axis 18 of the water jet. Sleeves 25 of various diameters can be selectively inserted and secured in the abrasive inlet 16. The inner diameters of the sleeves 25 are selected in conformity to the desired free distance (spacing) 20 in order to conform the effectiveness of the apparatus 10 to the desired cleaning or cutting conditions.

The orientation of the abrasive nozzle bore 212 parallel to and concentrically relative to the water jet axis 18 is advantageously effected by precise cylindrical and/or conical fitting elements 123, 124, 125, 126. In conjunction with a precisely configured abrasive nozzle bore 212, a symmetrical supply of a stream to the abrasive nozzle 21 is achieved, which leads to low focusing losses and a longer service life of the nozzle 21.

The use of components having greater tolerances, especially for discharge nozzles 21 that do not have a central discharge nozzle bore 212, allows the apparatus 10 to be provided with suitable adjustment possibilities.

Centering of the high pressure nozzle holder 122 via conical means, see for example the reference numeral 125 in FIG. 5, is advantageously utilized when it is desired to frequently open and close the mixing chamber 12, for example to check that possible scoring of the centering surfaces as a result of entering hard material particles is reliably prevented.

The use of the conical centering element 125 in conjunction with the soft-material sealing means 127 additionally permits a subsequent alignment of the abrasive inlet 16 on any desired position of the periphery after the apparatus 10 (cutting head) is installed.

Figure 6:
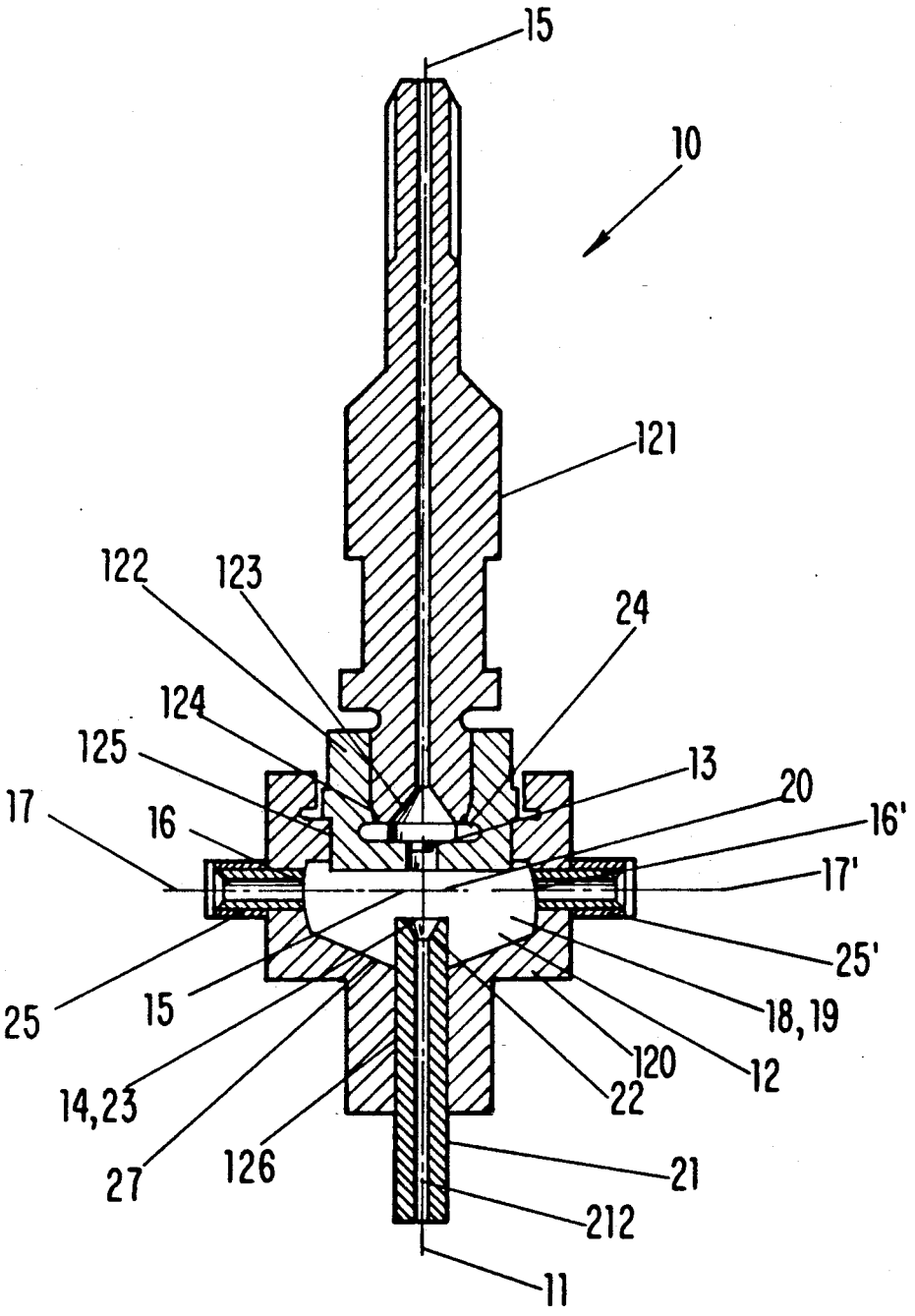
FIG. 6 shows an embodiment having two abrasive inlets.
Figure 7:
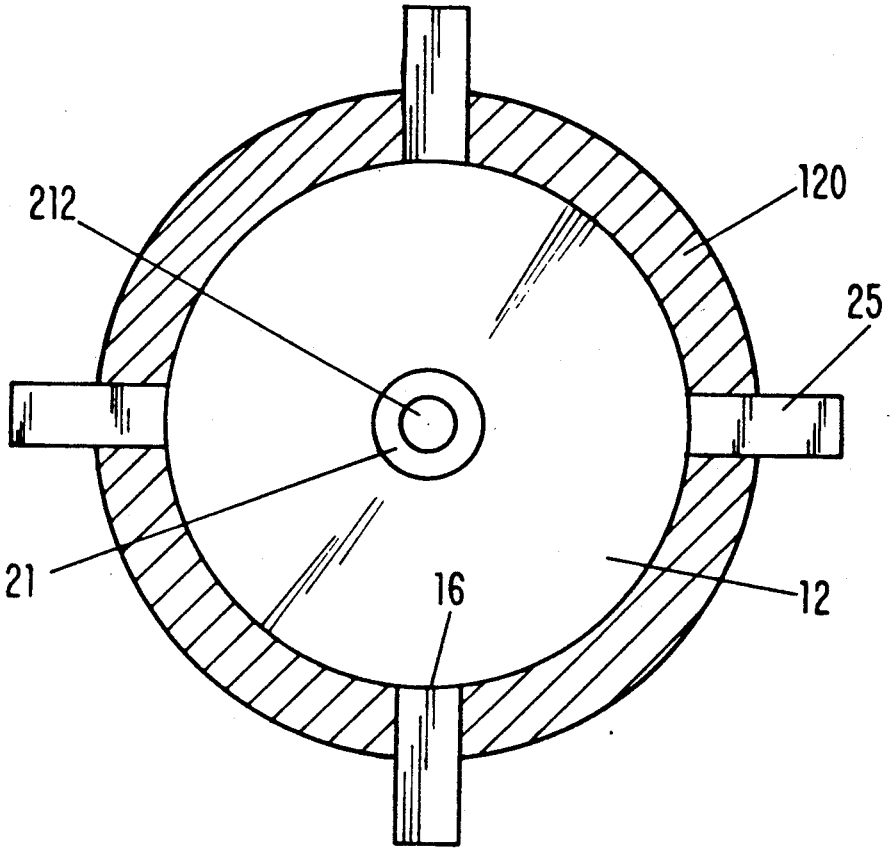
FIG. 7 shows in a schematic representation the arrangement of four abrasive inlets within the mixing chamber.
Figure 8:
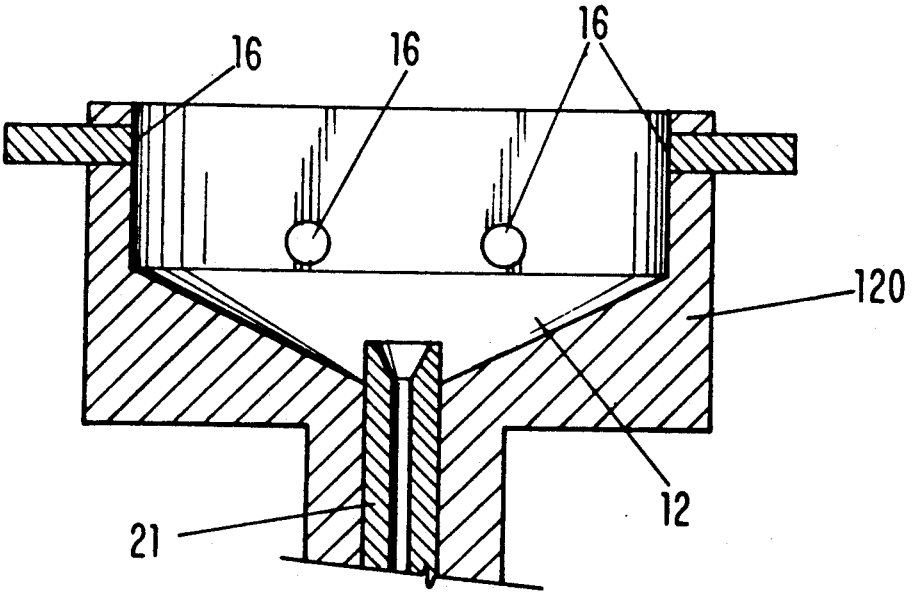
FIG. 8 shows in a schematic representation the arrangement of abrasive inlets at varying heights of the mixing chamber.

FIG. 6 shows a further embodiment in which the mixing chamber is provided with two abrasive inlets 16 that are arranged opposite one another about the circumference of the mixing chamber 12. The structure of the second abrasive inlet 16' is identical to the aforementioned inlet 16, having a corresponding sleeve 25' and a corresponding axis 17'. Thus the axes 17, 17' are oriented essentially perpendicular to the axis of the water jet 18. Of course, further abrasive inlets may be distributed about the circumference of the mixing chamber at certain selected, preferably equal, distances from one another, for example, three respective abrasive inlets may be positioned at an angle of 120° relative to one another or four such abrasive inlets may be spaced at a 90° angle relative to one another (see FIG. 7). It is also possible to vary the location of the abrasive inlets relative to one another with respect to the axial dimension of the mixing chamber (see FIG. 8).

Figure 3:
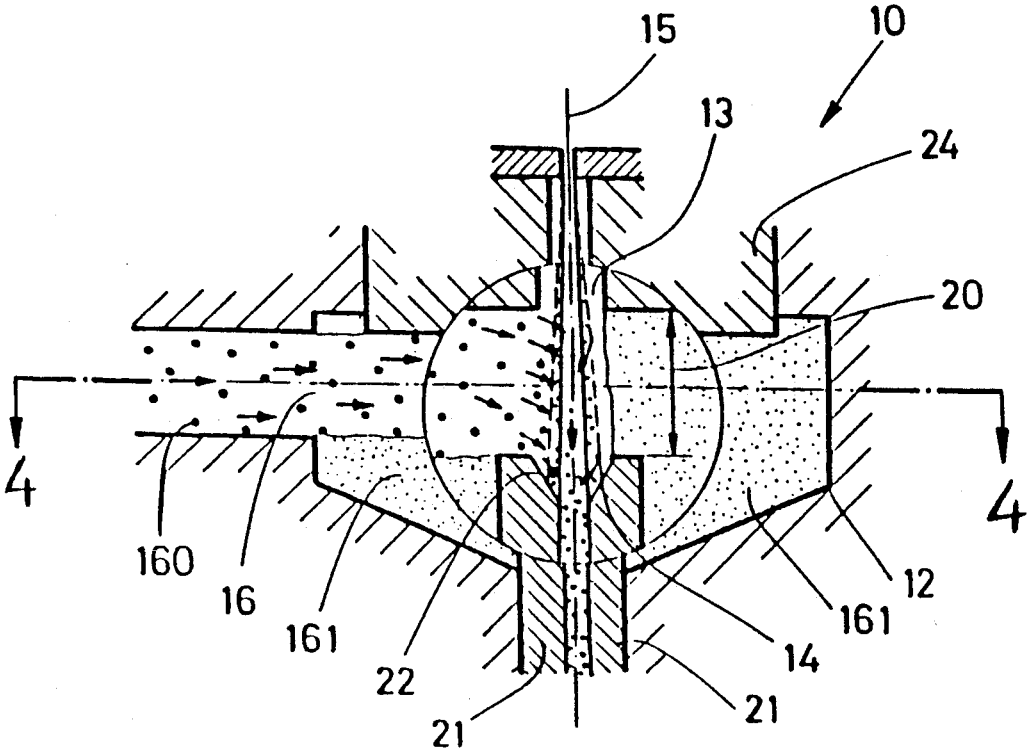
FIG. 3 is an enlarged schematic cross-sectional view showing the region of the mixing chamber with abrasive being blown therein, with a portion of the mixing chamber being even further enlarged.
Figure 4:
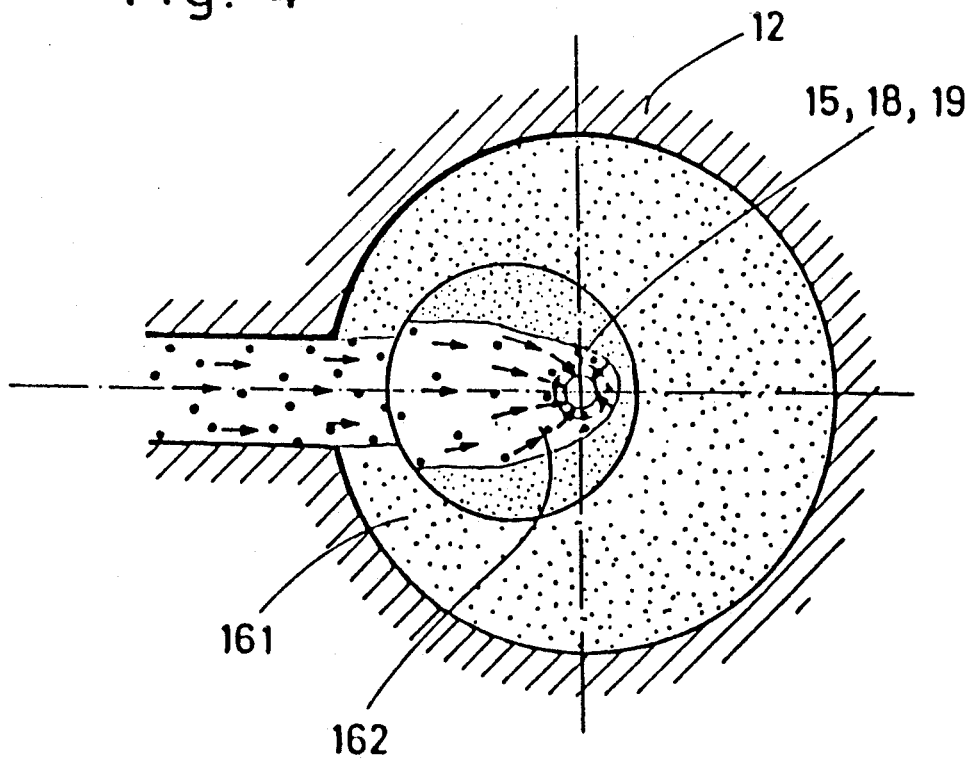
FIG. 4 is a cross-sectional view through the mixing chamber of FIG. 3 taken along the line 4—4, with a portion of the mixing chamber being even further enlarged.

The operation of the apparatus 10 will be described with the aid of FIGS. 3 and 4. A water jet 15, which is supplied to the apparatus in a known manner as described above, passes through the mixing chamber 12 from the inlet 13 to the outlet 14, whereby the free distance 20 is suitably adjusted in a predetermined manner. Through the abrasive inlet 16, abrasive 160 is directly blown in a very precise manner essentially at right angles to the axis 18 of the water jet. In so doing, the abrasive 160 is injected into the mixing chamber 12, for example by air having a pressure of 1 bar relative to the inner pressure of the mixing chamber.

With special applications, for example, in hyperbaric working chambers under water, the abrasive can also be supplied at higher pressures relative to the inner pressure of the mixing chamber 12. Under this mode of operation, the jet, mixing chamber, and abrasive supply parameters should be coordinated with one another.

The pressure at which the abrasive is introduced into the mixing chamber 12 depends on the ambient pressure. For example, when the device is operated in a remote-controlled manner under water at a depth of 500 m the abrasive pressure must be in a range of approximately 50 bar. During manual operation under water at a depth of 50 m the abrasive pressure must be at 5 bar. Thus, depending on the application, the abrasive pressure may vary over a wide range, i.e., from 1 to 120 bar.

Immediately after beginning to blow the abrasive 160 in, which can, for example, comprise all customary and natural or synthetically obtained or manufactured materials, such as quartz sand, granite sand, copper grit, corundum, hard metal particles, or other suitable solid materials, the abrasive collects around the outlet 14, which in the illustrated embodiment is formed by the discharge nozzle 21 that projects into the mixing chamber, with this abrasive piling up and forming, together with a spray water fraction that naturally occurs in the mixing chamber 12, moistened, piled-up abrasive 161. At the same time, an abrasive channel 162 forms in the piled-up abrasive 161 about the outlet 14; the subsequent abrasive coming from the abrasive inlet 16 is guided by the abrasive channel 162 into the jet of water 15. As a consequence of the deposition of the piled-up abrasive 161, the walls of the mixing chamber 12 are protected from erosion as a result of the abrasive 160 itself, so that it is even possible to use materials that are not very resistant to wear to produce the mixing chamber 12, for example such materials that are easy to work with and in addition are economical to produce.

As a consequence of the geometry of the abrasive channel 162, which is automatically formed as a function of the free distance 20 of the water jet 15 and as a function of the pressure of the abrasive 160, a suitable acceleration of the abrasive 160 can be effected. In other words, the effectiveness of the transfer of energy via the water jet 15 to the abrasive is optimized and is adapted to the respectively desired conditions. In so doing, the air jets that move in the throughbore of the discharge nozzle 21 to the free nozzle opening are suitable to further increase the transfer of energy to the abrasive 160. To optimize the quantity of air, the suitable dimensioning of the opening diameter of the abrasive inlet and also of the supply line of the abrasive 160 to the apparatus itself should therefore also be taken into consideration.

Pursuant to the method and apparatus 10 of the present invention, mixing chambers 12 having the following performance data can be produced and operated:

| | | |
|---|---|---|
| Pressure range of the water jet: | approximately | 300–6,000 bar |
| Hydraulic power: | | 0.5–50 kw |
| Quantity of abrasive: | | 0.1–10 kg/min |
| Quantity of air: | | 10–500 l/min |

In this connection, the discharge nozzle 21 can have an opening or passage diameter of 0.5 to 3 mm, with the length of the nozzle 21 being between 10 and 200 mm. The free distance (spacing) 20 can be between 2 and 80 mm.

The present invention is, of course, in no way restricted to the specific disclosure of the specification and drawings, but also encompasses any modifications within the scope of the appended claims.

What I claim is:

1. A method of producing a water/abrasive mixture for cutting and cleaning objects and surfaces and for the precise removal of material, said method comprising the steps of:

introducing an abrasive, in a mixing chamber, into a jet of water that is under high pressure and passes through said mixing chamber from an inlet to an outlet thereof; and conveying said abrasive directly and precisely to said jet of water in said mixing chamber in a pressure range of from greater than 1 to not more than 120 bar.

2. A method according to claim 1, which includes the step of conveying said abrasive into said mixing chamber in such a way that abrasive collects about said outlet while forming an abrasive channel, with said abrasive being deposited on all walls of said mixing chamber.

3. A method according to claim 1, in which said abrasive is conveyed to said jet of water at essentially right angles to an axis of said jet of water.

4. An apparatus for producing a water/abrasive mixture for cutting and cleaning objects and surfaces and for the precise removal of material, said apparatus comprising:

a mixing chamber having a first inlet for receiving a high pressure jet of water, an outlet for the discharge of said water jet after passage thereof through said mixing chamber along a water jet axis, and a second inlet for supplying said abrasive to said jet of water; with said second abrasive inlet of said mixing chamber having a central axis that extends essentially perpendicularly to said axis of said water jet in said mixing chamber, with said mixing chamber having an essentially cylindrical cross-sectional configuration, and with said water jet axis forming a central axis of said cylinder, which has a diameter that is greater than a free path length of said water jet through said mixing chamber.

5. An apparatus according to claim 4, in which said mixing chamber has a funnel-shaped configuration about said outlet thereof.

6. An apparatus according to claim 4, which includes a nozzle for the discharge of said water/abrasive mixture from said apparatus, with said discharge nozzle projecting at least partially into said mixing chamber and providing said outlet thereof.

7. An apparatus according to claim 6, in which said discharge nozzle is centrally disposed in said cylindrical mixing chamber.

8. An apparatus according to claim 6, in which said discharge nozzle is made of hard material.

9. An apparatus according to claim 6, in which said discharge nozzle is segmented into several parts.

10. An apparatus according to claim 6, in which said discharge nozzle, on a side facing said mixing chamber, has a funnel-shaped configuration that widens in the direction toward said mixing chamber.

11. An apparatus according to claim 6, in which said discharge nozzle, on a side facing said mixing chamber, has an inlet bore that enlarges a nozzle opening thereof.

12. An apparatus according to claim 6, which includes means for adjusting the free path length spacing between said first inlet and said outlet for said water jet in said mixing chamber.

13. An apparatus according to claim 12, in which said adjusting means comprises means for shifting said discharge nozzle and/or shifting a holder for a nozzle insert at which said first inlet of said mixing chamber is disposed.

14. An apparatus according to claim 12, in which said adjusting means comprises means for securing said discharge nozzle and/or said holder within a mixing chamber body.

15. An apparatus according to claim 4, which includes means for varying the cross-sectional configuration of said second abrasive inlet.

16. An apparatus according to claim 15, in which said means comprises sleeves having throughbores of various diameters.

17. An apparatus according to claim 15, which includes a plurality of second abrasive inlets that are directed into said mixing chamber.

18. An apparatus according to claim 4, which includes: a discharge nozzle means provided with said outlet for said mixing chamber, and precision cylindrical and/or conical fitting elements for centering said discharge nozzle means relative to said water jet axis.

* * * * *